US010471320B2

(12) United States Patent
Suzuki

(10) Patent No.: US 10,471,320 B2
(45) **Date of Patent: *Nov. 12, 2019**

(54) SPORTS PRACTICE TOOL

(71) Applicant: Takahito Suzuki, Osaka (JP)

(72) Inventor: Takahito Suzuki, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/306,085

(22) PCT Filed: Jun. 9, 2015

(86) PCT No.: PCT/JP2015/066540
§ 371 (c)(1),
(2) Date: Oct. 22, 2016

(87) PCT Pub. No.: WO2015/190449
PCT Pub. Date: Dec. 17, 2015

(65) Prior Publication Data

US 2017/0036085 A1 Feb. 9, 2017

(30) Foreign Application Priority Data

Jun. 10, 2014 (JP) ..... 2014-119153

(51) Int. Cl.
*A63B 69/00* (2006.01)
*A63B 69/36* (2006.01)
(Continued)

(52) U.S. Cl.
CPC ..... *A63B 69/00* (2013.01); *A63B 15/00* (2013.01); *A63B 59/70* (2015.10);
(Continued)

(58) Field of Classification Search
CPC ..... A63B 69/00; A63B 69/0002; A63B 69/26; A63B 69/36
(Continued)

(56) References Cited

U.S. PATENT DOCUMENTS 1,528,017 A * 3/1925 Gammeter ..... A63B 53/04 144/24.22
1,601,116 A * 9/1926 Hall ..... A63B 59/70 473/562
(Continued)

FOREIGN PATENT DOCUMENTS

JP 3188636 U 1/2014

OTHER PUBLICATIONS

English translation of the International Search Report of PCT/JP2015/066540.

*Primary Examiner* — Melba Bumgarner
*Assistant Examiner* — Laura Davison
(74) *Attorney, Agent, or Firm* — Muncy, Geissler, Olds & Lowe, P.C.

(57) ABSTRACT

A sports practice tool 1 comprising a grip 20 on a proximal end side of a practice tool main body 10, wherein the practice tool main body 10 comprises a first flexible part 12 and a second flexible part 14 extending in mutually different directions along a first imaginary plane P1, the first flexible part 12 and the second flexible part 14 are connected to each other in a bent manner, the first flexible part 12 is formed such that primary deflective deformation occurs along the first imaginary plane P1, and the second flexible part 14 is formed such that primary deflective deformation occurs along a second imaginary plane P2 that intersects the first imaginary plane P1.

14 Claims, 10 Drawing Sheets

(51) Int. Cl.

| | |
|---|---|
| ***A63B 15/00*** | (2006.01) |
| ***A63B 59/70*** | (2015.01) |
| *A63B 69/02* | (2006.01) |
| *A63B 69/38* | (2006.01) |
| *A63B 60/00* | (2015.01) |

(52) U.S. Cl.
CPC ..... *A63B 69/0002* (2013.01); *A63B 69/36* (2013.01); *A63B 69/3623* (2013.01); *A63B 69/0026* (2013.01); *A63B 69/02* (2013.01); *A63B 69/38* (2013.01); *A63B 2060/0081* (2015.10); *A63B 2069/0006* (2013.01); *A63B 2069/0008* (2013.01); *A63B 2209/00* (2013.01)

(58) Field of Classification Search
USPC ..... 473/219, 560
See application file for complete search history.

(56) References Cited

U.S. PATENT DOCUMENTS 2,153,550 A * 4/1939 Cowdery ..... A63B 53/12 473/323
2,482,015 A * 9/1949 McConnell ..... A63B 69/3638 473/226
5,174,567 A * 12/1992 Nordstrom ..... A63B 15/00 473/230
5,335,908 A * 8/1994 Bamber ..... A63B 53/02 473/317
5,632,692 A * 5/1997 Lebovici ..... A63B 53/10 273/DIG. 23
5,913,733 A * 6/1999 Bamber ..... A63B 53/02 473/317
6,027,414 A * 2/2000 Koebler ..... A63B 53/02 473/228
6,113,508 A * 9/2000 Locarno ..... A63B 59/00 473/318
6,257,997 B1 * 7/2001 Doble ..... A01K 87/00 473/318
6,817,957 B2 * 11/2004 Flaum ..... A63B 53/02 473/563
7,140,398 B2 * 11/2006 Dodge ..... A43B 13/026 138/172
9,737,747 B1 * 8/2017 Walsh ..... A01K 87/00
2005/0181897 A1 * 8/2005 Chen ..... A63B 60/54 473/563
2007/0270253 A1 * 11/2007 Davis ..... A63B 59/70 473/513
2017/0136281 A1 * 5/2017 Chipperfield ..... A63B 21/0004

* cited by examiner

SPORTS PRACTICE TOOL

TECHNICAL FIELD

The present invention relates to a sports practice tool and, more specifically, a sports practice tool that is suitable to use for the practice of sports that are played with a rod-like object, such as golf, baseball, and kendo.

BACKGROUND ART

In order to efficiently hit an object such as a ball with a rod-like object used for sports, e.g., golf and baseball, it is considered necessary to effectively utilize the flex of the rod-like object. For example, in a golf swing or a similar swing, it is necessary to control flex in the right and left directions to produce a counter shaft flex (a whip action) at impact, control flex in the upward and downward directions in a previous phase, and, further, control flex during the waggle, forward press, backswing, and like phases.

However, since rod-like objects used for sports are highly rigid in general, it is difficult to feel flex, and even when flex occurs, it can occur in a random direction, and it is thus difficult to learn how to flex a rod-like object in order for a user to make an efficient hit.

The golf swing practice tool disclosed in Patent Literature 1 is a known example of conventional practice tools. This golf swing practice tool comprises a rod-like shaft part corresponding to a golf club shaft and a dummy club head part connected to the shaft part, wherein the shaft part and the dummy club head part are bent at an angle corresponding to the lie angle of a golf club.

CITATION LIST

Patent Literature

Patent Literature 1: Japanese Registered Utility Model No. 3188636

SUMMARY OF INVENTION

Technical Problem

Although the above-described conventional golf swing practice tool is described as enabling a user to learn a correct swing form, the golf swing practice tool does not function to enable a user to feel flex that acts on the shaft, and is thus problematic in that the user cannot comprehend how to flex the shaft during a swing. It is therefore difficult for the user to learn, for example, the timing of cocking, hinging, releasing, and the like for producing an effective shaft flex as well as counter shaft flex, and a counter movement that takes advantage of leverage in a grip.

Accordingly, an object of the present invention is to provide a sports practice tool with which a user can easily learn efficient use of rod-like objects used for sports.

Solution to Problem

The foregoing object of the present invention is achieved by a sports practice tool comprising a grip on a proximal end side of a practice tool main body, wherein the practice tool main body comprises a first flexible part and a second flexible part extending in mutually different directions along a first imaginary plane, the first flexible part and the second flexible part are connected to each other in a bent manner, the first flexible part is formed such that primary deflective deformation occurs along the first imaginary plane, and the second flexible part is formed such that primary deflective deformation occurs along a second imaginary plane that intersects the first imaginary plane.

In this sports practice tool, it is preferable that the first imaginary plane and the second imaginary plane are perpendicular to each other.

It is preferable that the first flexible part and the second flexible part are connected to each other to be bent at an obtuse angle.

It is preferable that the grip is connected to the first flexible part.

It is preferable that the first flexible part and the second flexible part are both composed of a flat, plate-like object and are flexible in their respective thickness directions.

It is possible for the sports practice tool to comprise an elongated elastic object, wherein one side of the elastic object is fixed to at least the first flexible part or the second flexible part, and the other side of the elastic object curls away from the first flexible part or the second flexible part and contracts into a spiral shape due to resilience.

Advantageous Effects of Invention

The present invention provides a sports practice tool with which a user can easily learn efficient use of rod-like objects used for sports.

DESCRIPTION OF EMBODIMENTS

Figure 1:
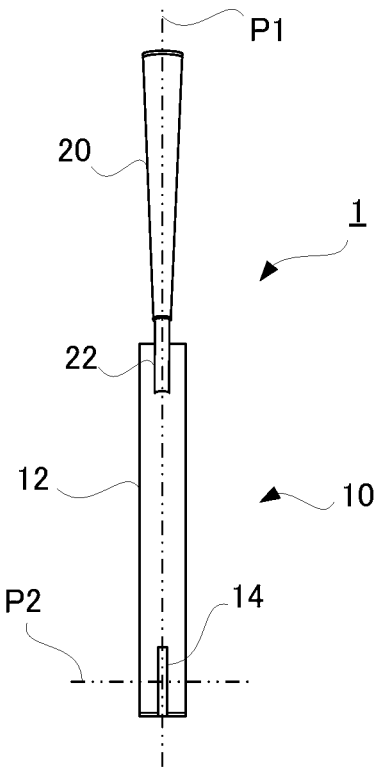
FIG. 1 is a front view of a sports practice tool according to one embodiment of the present invention.
Figure 2:
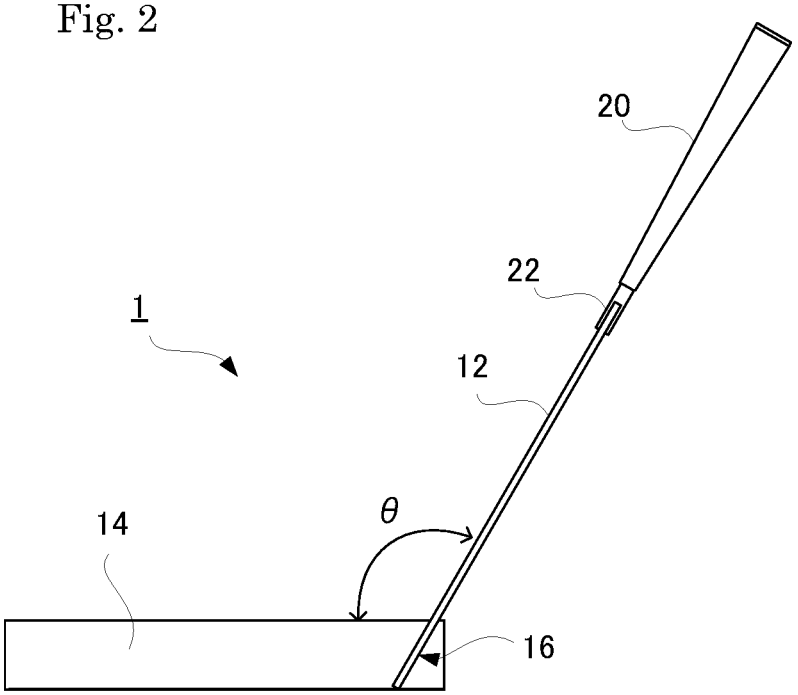
FIG. 2 is a side view of the sports practice tool shown in FIG. 1.

Below, an embodiment of the present invention will now be described with reference to the attached drawings. FIG. 1 is a front view of a sports practice tool according to one embodiment of the present invention, and FIG. 2 is a side view of the sports practice tool shown in FIG. 1. The sports practice tool shown in FIG. 1 and FIG. 2 is used for practicing a golf swing, and comprises a practice tool main body 10 and a grip 20 provided on the proximal end side of the practice tool main body 10.

The practice tool main part 10 comprises a first flexible part 12 and a second flexible part 14 each composed of a flat, plate-like object. The first flexible part 12 and the second flexible part 14 are positioned so as to extend in mutually different directions along a first imaginary plane P1 shown in FIG. 1, and connected to each other at a connecting part 16 in a bent manner.

The first flexible part 12 and the second flexible part 14 are made of a metallic material such as titanium, aluminum, magnesium, or alloy thereof, or a non-metallic material such as carbon or graphite, and are deflectively deformable in their respective thickness directions. It is possible that the first flexible part 12 and the second flexible part 14, for example, are made of the same material and have the same cross-sectional shape.

The proximal end part of the first flexible part 12 is held and secured by a holding part 22 provided on the grip 20. The broader surface of the distal end part of the first flexible part 12 is notched in the center, the proximal end part of the second flexible part 14 is inserted perpendicular to its thickness direction into this notch and secured by welding or the like, and the connecting part 16 is formed in this way. As shown in FIG. 1, the first flexible part 12 and the second flexible part 14 are connected to each other at the connecting part 16 so as to form a predetermined bent angle θ as viewed perpendicular to the first imaginary plane P1.

The lengths of the first flexible part 12 and the second flexible part 14 in their respective axial directions may be mutually different or may be the same. It is preferable to ensure such lengths that the flex of the first flexible part 12 and the flex of the second flexible part 14 can be felt by a user.

The first flexible part 12 is positioned such that its broader surface is perpendicular to the first imaginary plane P1 shown in FIG. 1, and deflective deformation (flex) primarily occurs along the first imaginary plane P1. On the other hand, the second flexible part 14 is positioned such that its broader surface is perpendicular to a second imaginary plane P2 shown in FIG. 1, and deflective deformation (flex) primarily along the second imaginary plane P2. The first imaginary plane P1 and the second imaginary plane P2 are perpendicular to each other and, accordingly, the first flexible part 12 and the second flexible part 14 deflectively deform in mutually perpendicular directions.

Figure 3:
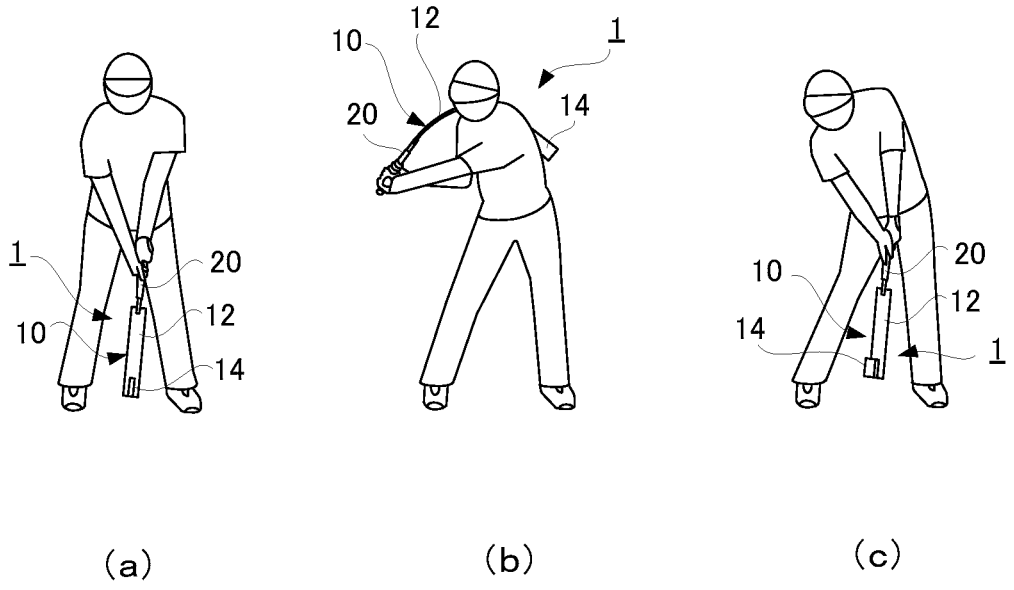
FIG. 3 shows drawings for explaining a method for using the sports practice tool shown in FIG. 1, and FIG. 3(*a*) shows a state at address, FIG. 3(*b*) shows a state during the course of a downswing, and FIG. 3(*c*) shows a state at impact.

The sports practice tool 1 having the above-described configuration can be used for practicing a golf swing in the following manner. First, as shown in FIG. 3(*a*), a user holds the grip 20 to be at address, assuming that the hitting destination is to the right in the drawing. In this state, the first flexible part 12 is positioned so as to deflectively deform along the first imaginary plane extending forward and backward from the user, and the second flexible part 14 is positioned so as to deflectively deform along the second imaginary plane extending rightward and leftward from the user.

Then, the user performs a backswing. When initiating a backswing, the user swings up the practice tool main body 10 in the lateral direction (to the left in FIG. 3(*a*)) mainly by the rotation of the body to cause the second flexible part 14 to flex in the direction of the swing. Thereafter, the practice tool main body 10 is further swung up in the vertical direction mainly by the movement of the arms to cause the first flexible part 12 to flex in the direction of the swing. After the backswing is completed in this way, the user successively performs a downswing.

When initiating a downswing, first, the grip 20 is brought downward. At this time, as shown in FIG. 3(*b*), the flex direction of the first flexible part 12 (to the right in FIG. 3(*b*)) attained during the backswing is maintained. Then, due to a counter movement in the vertical direction performed by the user, the distal end side of the first flexible part 12 is greatly accelerated downward, and the flex direction of the first flexible part 12 is inverted. Thereby, a large downward inertial force together with gravity acts on the distal end part of the second flexible part 14. The aforementioned counter movement means a movement that causes a force to act on the grip 20 in the direction opposite to the direction of the swing to decelerate the motion of the grip 20 (the same also applies below).

Figure 4:
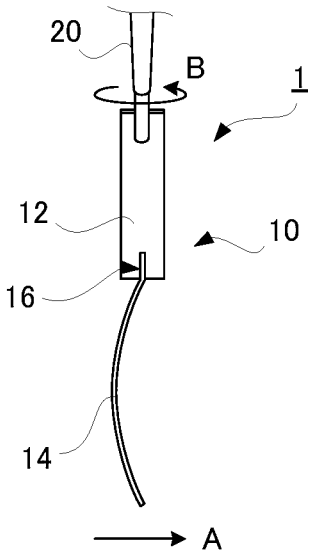
FIG. 4 is a plan view showing an example of a state during use of the sports practice tool shown in FIG. 1.

Thereafter, when the user swings the practice tool main body 10 in the lateral direction by the rotation of the body, the second flexible part 14 greatly deflects in the direction opposite to the direction of the swing due to the downward inertial force remaining in the distal end part of the second flexible part 14. Then, due to a counter movement in the lateral direction performed by the user, the distal end part of the second flexible part 14 is greatly accelerated in the hitting direction and, as shown in FIG. 3(*c*), the flex direction of the second flexible part 14 is inverted toward the right in the drawing. Thus, while causing the second flexible part 14 to flex in the hitting direction, a state at impact is reached. FIG. 4 is a plan view depicting the state at impact shown in FIG. 3(*c*). As shown in FIG. 4, so-called "counter shaft flex", which is flex exerted in the same direction as the hitting direction (the direction of arrow A) occurs to the distal end part of the second flexible part 14.

How to use the above-described sports practice tool 1 is the same as using a shaft in an efficient way when swinging a conventional golf club. When the sports practice tool 1 of the present embodiment is swung, the primary deflective deformation of the first flexible part 12 and the primary deflective deformation of the second flexible part 14 occur only along the first imaginary plane P1 and the second imaginary plane P2, respectively. Therefore, a user can easily check whether an efficient swing is accomplished or not by feeling the deflection of the first flexible part 12 and the deflection of the second flexible part 14 during a swing. One or more slits extending in the longitudinal direction may be formed in the first flexible part 12 and the second flexible part 14, and this enables flex to occur more easily.

Since the first flexible part 12 and the second flexible part 14 are positioned along the first imaginary plane P1 and connected to each other in a bent manner, it is easy for a user to visualize the first imaginary plane P1 formed by the first flexible part 12 and the second flexible part 14. It is thus possible for a user to easily understand, during a swing, the directions in which the first flexible part 12 and the second flexible part 14 should be flexed. Since the broader surface of the second flexible part 14 is parallel to the first imaginary plane P1, it is possible for a user to easily visualize a ball being hit with the first imaginary plane P1.

Also, forming the first flexible part 12 and the second flexible part 14 in a flat shape makes it possible for a user to visualize in what directions the first flexible part 12 and the second flexible part 14 should be flexed even before making a swing, and can encourage an efficient swing.

The bent angle θ (see FIG. 2) between the first flexible part 12 and the second flexible part 14 at the connecting part 16 is preferably an obtuse angle (for example, 135 degrees), and is more preferably set at such an angle that the second flexible part 14 extends substantially parallel to the ground when a user is at the same address as performing a swing with a conventional golf club. With such a bent angle θ, the flex direction of the second flexible part 14 at impact is close to the horizontal direction in which the user's body rotates, and it is thus easier for the user to feel an efficient swing. The bent angle θ may be a right angle or an acute angle, and in such a case as well, it is possible to encourage the user to perform a swing while being aware of the first imaginary plane P1.

Meanwhile, when swinging a conventional golf club or the like, not only the above-described flex but also twist occurs to a shaft. That is to say, a golf club shaft is twisted clockwise during from a backswing to halfway through a downswing, then counter-twisted counterclockwise after halfway through a downswing, and reaches an impact. Concerning the sports practice tool 1 of the present embodiment, the first flexible part 12 and the second flexible part 14 each have a shape that easily allows twist, and, moreover, are connected to each other in such a bent manner that a large torque acts on the distal end part of the first flexible part 12 that is close to the grip 20. Accordingly, at impact, a large counter-twist occurs to the practice tool main body 10 in the direction in which the distal end part of the second flexible part 14 is accelerated, as indicated by the direction of arrow B in FIG. 4. In this way, a user can feel twist that is more amplified than the twist which occurs to a conventional golf club.

One embodiment of the present invention has been described in detail above, but the specific aspects of the present invention are not limited to the above embodiment. For example, although the grip 20 is connected to the first flexible part 12 that deflectively deforms along the first imaginary plane P1 in the above embodiment, the grip 20 may be connected to the second flexible part 14 that deflectively deforms along the second imaginary plane P2. With this configuration as well, it is possible to perform a swing practice that allows the flex of the first flexible part 12 and the flex of the second flexible part 14 to be felt. A means of connecting the first flexible part 12 and the second flexible part 14 is not particularly limited as long as the first flexible part 12 and the second flexible part 14 are reliably joined to each other, such as adhesive-bonding, fitting, or fixing using a screw or a rivet, in addition to welding or brazing. Moreover, the first flexible part 12 and the second flexible part 14 may be configured to be attachable to and detachable from each other. Instead of using separate components for the first flexible part 12 and the second flexible part 14, the first flexible part 12 and the second flexible part 14 may be formed by twisting the middle of a strip-like object to provide them on the respective sides of the twisted portion.

In the above embodiment, the first flexible part 12 and the second flexible part 14 overlap each other at the connecting part 16, and the connecting part 16 becomes a highly rigid part accordingly. More specifically, the connecting part 16 has a flexural rigidity in the direction of the first imaginary plane P1 and a flexural rigidity in the direction of the second imaginary plane P2 that are both equal to or greater than the flexural rigidities of the first flexible part 12 and the second flexible part 14 compared in the respective directions. That is, in the direction of the first imaginary plane P1, the flexural rigidity of the second flexible part 14 is at a greater value than the flexural rigidity of the first flexible part 12, while the flexural rigidity of the connecting part 16 in the direction of the first imaginary plane P1 is equal to or greater than the flexural rigidity of the second flexible part 14 in this direction. Similarly, in the direction of the second imaginary plane P2, the flexural rigidity of the first flexible part 12 is at a greater value than the flexural rigidity of the second flexible part 14, while the flexural rigidity of the connecting part 16 in the direction of the second imaginary plane P2 is equal to or greater than the flexural rigidity of the first flexible part 12 in this direction. Configuring the connecting part 16 in this way makes it possible, when the first flexible part 12 and the second flexible part 14 flexurally deform in different directions, to nullify the influence of bending on each other by the connecting part 16, and thus reliably enables the first flexible part 12 and the second flexible part 14 to flex along the first imaginary plane P1 and the second imaginary plane P2, respectively. The flexural rigidity can be obtained from the product of a Young's modulus and a second moment of area, and can be calculated from the material and the cross-sectional shape. When it is difficult to calculate flexural rigidity from the cross-sectional shape, the flexural rigidity may be obtained by a three-point bending test as with the measurement of flexural rigidity of a golf shaft that is commonly performed. However, it is not essential to the present invention that the connecting part 16 serves as a highly rigid part, and the above-described highly rigid part does not need to be provided between the first flexible part 12 and the second flexible part 14. For example, the connecting part 16 may be formed as a cylinder or a circular column made of synthetic resin, rubber, or the like so as to be easily deformable in a twisted manner.

The first flexible part 12 and the second flexible part 14 are not limited to the plate-like objects of the above embodiment as long as their primary deflective deformations respectively occur along the first imaginary plane P1 and the second imaginary plane P2. The direction of "primary deflective deformation" means the direction in which the amount of deflection in the direction of action of external force is maximum when one end of the first flexible part 12, or one end of the second flexible part 14, is fixed and external force is applied to the other end, and is normally the direction in which flexural rigidity is minimum. The present invention does not exclude a configuration in which the first flexible part 12 and the second flexible part 14 deflectively deform slightly in directions other than their primary deflective directions.

Figure 5:
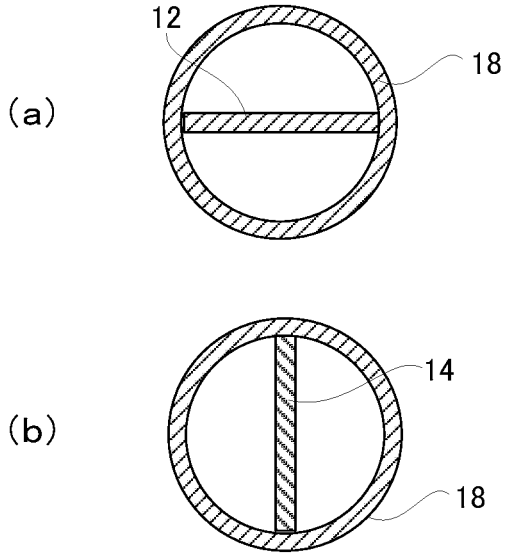
FIG. 5 shows cross-sectional views of relevant parts of a sports practice tool according to another embodiment of the present invention, and FIG. 5(*a*) is a cross-sectional view of a first flexible part, and FIG. 5(*b*) is a cross-sectional view of a second flexible part.
Figure 6:
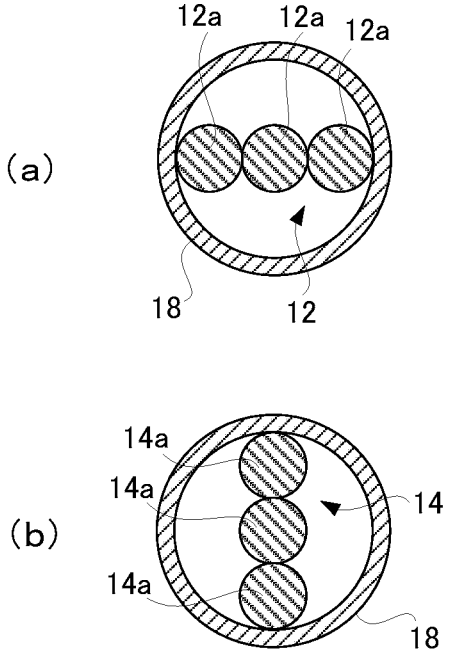
FIG. 6 shows cross-sectional views of relevant parts of a sports practice tool according to yet another embodiment of the present invention, and FIG. 6(*a*) is a cross-sectional view of a first flexible part, and FIG. 6(*b*) is a cross-sectional view of a second flexible part.

For example, as a modification to the first flexible part 12 and the second flexible part 14, the first flexible part 12 and the second flexible part 14 can be accommodated in a cylindrical covering tube 18 that covers the first flexible part 12 and the second flexible part 14 integrally, as shown in the cross-sectional views in FIGS. 5(*a*) and 5(*b*). For the covering tube 18, the same shaft as that used for a conventional golf club, such as a steel shaft or a carbon shaft, is usable, thus the sports practice tool 1 is closer in appearance to a conventional golf club, and more practical training can be performed. The first flexible part 12 and the second flexible part 14 have a flat, rectangular cross-sectional shape in FIGS. 5(*a*) and 5(*b*), but as shown in the cross-sectional views in FIGS. 6(*a*) and 6(*b*), the first flexible part 12 and the second flexible part 14 each may be configured to have a plurality of linear objects 12*a* or 14*a* parallelly arranged in one direction so as to be in contact with each other and integrated into a single body.

Figure 7:
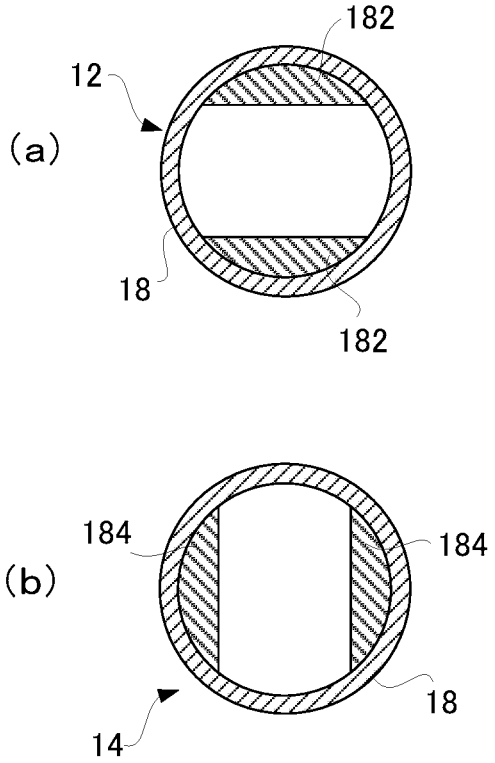
FIG. 7 shows cross-sectional views of relevant parts of a sports practice tool according to yet another embodiment of the present invention, and FIG. 7(*a*) is a cross-sectional view of a first flexible part, and FIG. 7(*b*) is a cross-sectional view of a second flexible part.

Alternatively, as shown in the cross-sectional views in FIGS. 7(*a*) and 7(*b*), it is possible to configure the first flexible part 12 and the second flexible part 14 such that solid parts 182 and 184 constituting the inner circumferential surface of the covering tube 18 are placed in different positions in the circumferential direction. Instead of forming the solid parts on the inner circumferential surface of the covering tube 18 as in this embodiment, it is also possible to partially form the solid parts along the outer circumferential surface of the covering tube 18, and it is also possible to form the solid parts by multiple layers. Also, the solid parts can be formed on the covering tube 18 by, for example, altering the thickness of a coating applied to the covering tube 18 in the circumferential direction, or in the case of a carbon shaft, by partially increasing the amount of carbon sheet used.

Figure 8:
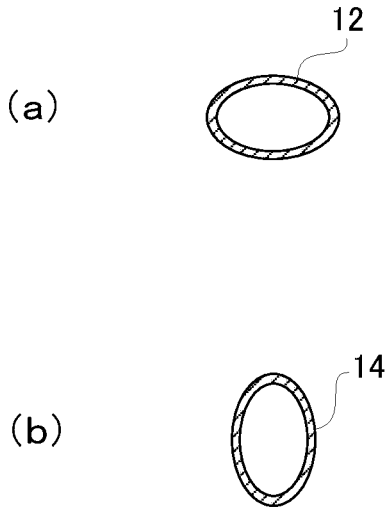
FIG. 8 shows cross-sectional views of relevant parts of a sports practice tool according to yet another embodiment of the present invention, and FIG. 8(*a*) is a cross-sectional view of a first flexible part, and FIG. 8(*b*) is a cross-sectional view of a second flexible part.

As for a shape that determines the direction of primary deflective deformation of the first flexible part 12 and the second flexible part 14, a shape from which the deformation direction is apparent can be preferably selected. For example, in addition to the flat, plate-like shape, an elliptical cross-sectional shape as shown in the cross-sectional views of FIGS. 8(*a*) and 8(*b*) may be used.

In the embodiments described above, it is preferable that the first imaginary plane P1 and the second imaginary plane P2 are perpendicular to each other, but as long as an efficient swing is encouraged, intersecting arrangements other than the perpendicular arrangement may be adopted.

Figure 9:
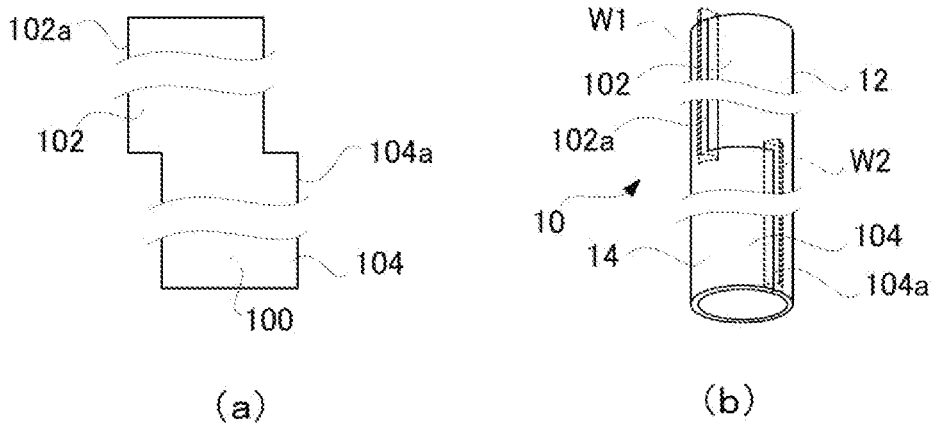
FIG. 9 shows drawings of a relevant part of a sports practice tool according to yet another embodiment of the present invention, and FIG. 9(*a*) is a development view of the relevant part, and FIG. 9(*b*) is a perspective view of the relevant part.

The first flexible part 12 and the second flexible part 14 can be also formed as follows. As shown in the development view in FIG. 9(*a*), lug parts 102 and 104 are formed on the respective right and left sides of a rectangular flat plate 100 such that these lug parts 102 and 104 are not immediately above or below relative to each other, and rolling this flat plate 100 into a cylindrical form to create the main body 10 places tip edges 102*a* and 104*a* of the lug parts 102 and 104 in different positions in the circumferential direction of the practice tool main body 10 as shown in FIG. 9(*b*). Then, when these tip edges 102*a* and 104*a* are welded to form the practice tool main body 10 of a linear cylindrical shape, welded parts W1 and W2 become so-called spines, i.e., portions with high flexural rigidity, and it is thus possible to form the first flexible part 12 and the second flexible part 14 whose directions of primary deflective deformation are mutually different in the upper and lower parts of the practice tool main body 10, respectively. Thereafter, the middle section between the first flexible part 12 and the second flexible part 14 is bent, and in this way the practice tool main body 10 can be obtained in which the first flexible part 12 and the second flexible part 14 are connected to each other in a bent manner. Formation of the spines is not necessarily limited to welding, and, for example, thick portions resulting from overlapping of a carbon sheet when a carbon shaft is formed can be regarded as spines. In the case of providing the above-described highly rigid part between the first flexible part 12 and the second flexible part 14, for example, a ring-shaped component can be externally attached so as to surround the portion between the first flexible part 12 and the second flexible part 14.

Figure 10:
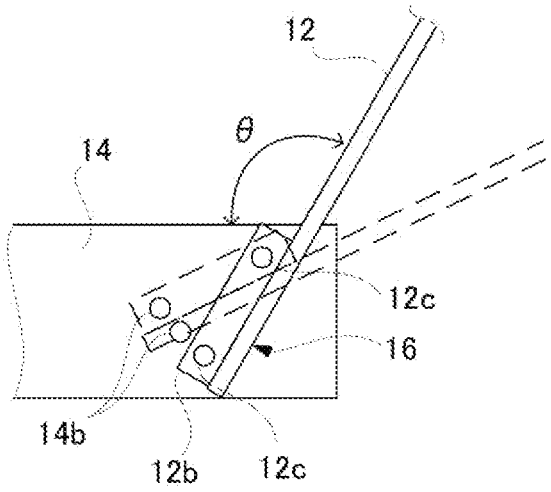
FIG. 10 is a side view of relevant parts of a sports practice tool according to yet another embodiment of the present invention.

The connecting means for the first flexible part 12 and the second flexible part 14 may be capable of adjusting the bent angle θ. For example, as shown in FIG. 10, the connecting means may be configured in such a way that a plurality of through-holes 12*c* are formed in an attachment plate 12*b* provided on the distal end part of the first flexible part 12, a plurality of through-holes 14*b* are formed in the second flexible part 14 so as to allow a through-hole 14*b* to be suitably selected for alignment with a through-hole 12*c*, and the attachment plate 12*b* and the second flexible part 14 are joined by fastening means such as a bolt and a nut to provide a bent angle θ corresponding to the selected through-hole 14*b*. As for a bent angle θ adjustment mechanism, the connecting part 16 may be provided with, for example, a ratchet mechanism in which a pawl and a ratchet wheel engage so that the bent angle θ is adjustable in a step-wise manner.

Figure 11:
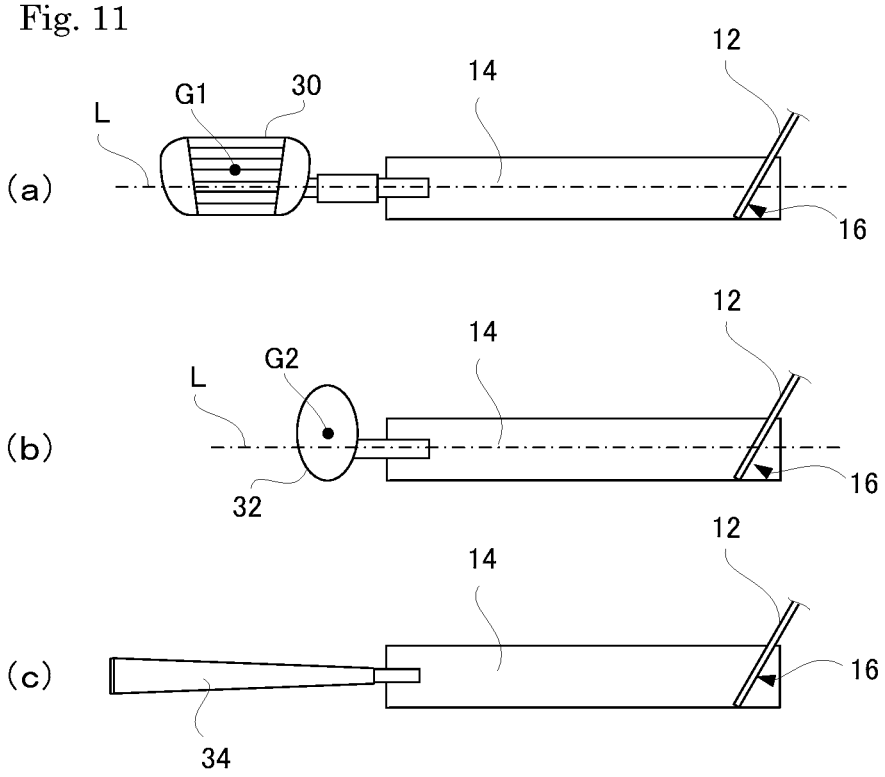
FIG. 11(*a*) to FIG. 11(*c*) are side views of relevant parts of a sports practice tool according to yet another embodiment of the present invention.

As shown in FIG. 11(*a*), a hitting part 30 capable of hitting a golf ball may be provided on the distal end part of the second flexible part 14 to enable the practice of actually hitting a ball. Alternatively, as shown in FIG. 11(*b*), a weight 32 may be provided on the distal end part of the second flexible part 14 so that the flex of the first flexible part 12 and the flex of the second flexible part 14 are more easily produced by the centrifugal force that acts on the weight 32. Alternatively, as shown in FIG. 11(*c*), a grip 34 may be provided on the distal end part of the second flexible part 14 so that the grip 20 provided on the first flexible part 12 and the grip 34 can be appropriately selected for intended purposes. Center-of-gravity positions G1 and G2 of the hitting part 30 and the weight 32 shown in FIG. 11(*a*) and FIG. 11(*b*), respectively, are preferably above an axial line L of the second flexible part 14 and, accordingly, the twist deformation of the first flexible part 12 and the twist deformation of the second flexible part 14 that occur during a swing are increased, and a user can feel such twist deformation more easily. The center-of-gravity positions G1 and G2 of the hitting part 30 and the weight 32, respectively, may be adjustable as desired, by attaching or removing one or more weight adjusting means (not shown).

Figure 12:
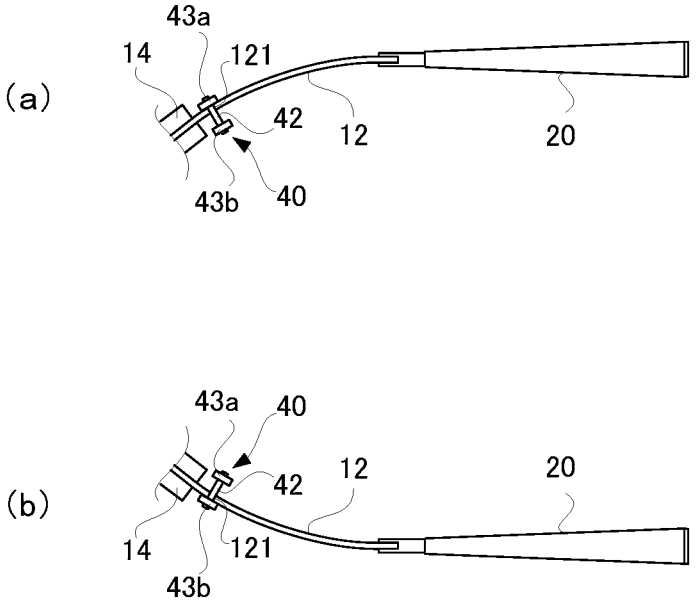
FIG. 12 shows front views of relevant parts of a sports practice tool according to yet another embodiment of the present invention, and FIG. 12(*a*) and FIG. 12(*b*) each show an example of a state during use.

Moreover, as shown in FIGS. 12(*a*) and 12(*b*), a movable object 40 that moves due to flex may be provided on the distal end part of the first flexible part 12. The movable object 40 comprises stoppers 43*a* and 43*b* at the respective ends of a rod 42 that is inserted into a through-hole 121 formed in the first flexible part 12, and is positioned such that a gap is created between the first flexible part 12 and either the stopper 43*a* or 43*b*. According to this configuration, when the state shown in FIG. 12(*b*) in which the first flexible part 12 flexes upward is reached from the state shown in FIG. 12(*a*) in which the first flexible part 12 flexes downward, the movable object 40 moves upward, and the stopper 43*b* collides with the first flexible part 12. A user can understand the flex state of the first flexible part 12 through vibrations and sounds generated at this time, and can check whether an efficient swing is being performed or not during a swing. As with the first flexible part 12, the second flexible part 14 can also have a configuration that causes vibrations, sounds, or the like to be generated due to flex.

Figure 13:
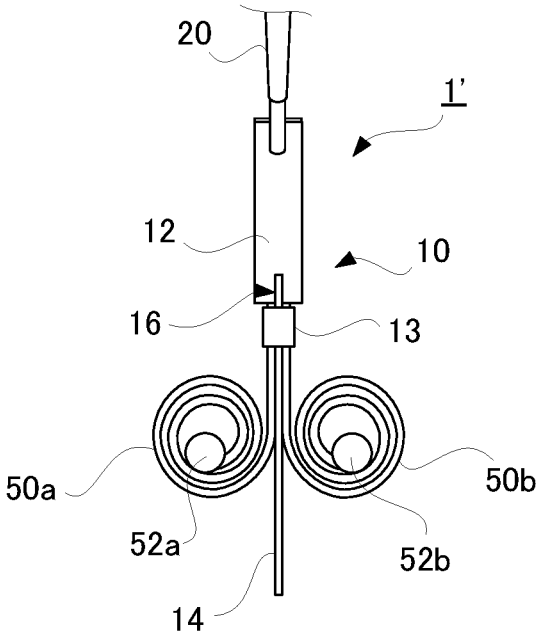
FIG. 13 is a front view of a sports practice tool according to yet another embodiment of the present invention in a state during use.

FIG. 13 is a plan view showing a sports practice tool 1' in a state during use, which is a modification to the sports practice tool 1 shown in FIGS. 1 and 2. This sports practice tool 1' is identical to the sports practice tool 1 shown in FIGS. 1 and 2 except for comprising elastic objects 50*a* and 50*b* on the front and back surfaces of the second flexible part 14, respectively.

The elastic objects 50*a* and 50*b* are each formed by attaching one or more wire rods composed of spring steel to the back surface of a thin, belt-like substrate composed of paper, synthetic resin, or the like in the longitudinal direction. The proximal end side of the elastic objects 50*a* and 50*b* is fixed to the proximal end part of the second flexible part 14 by a fastener 13 such as tape or bushing. The distal end side of the elastic objects 50*a* and 50*b* is curled in a mutually opposite directions into a spiral shape so as to be away from the second flexible part 14. Curling treatment has been performed on the elastic objects 50*a* and 50*b* so that once the other side is released from a hand, the elastic objects 50*a* and 50*b* in a stretched state wind themselves and contract into a spiral shape as shown in FIG. 13 due to resilience. The elastic objects 50*a* and 50*b* can be composed of a spring strip as long as the elastic objects 50*a* and 50*b* are so elastic that they securely return to their original shape after being stretched. Weights 52*a* and 52*b* composed of a metal ball or the like are provided on the other side of the elastic objects 50*a* and 50*b*, respectively, to promote the stretch of the elastic objects 50*a* and 50*b* resulting from the action of an external force.

Figure 14:
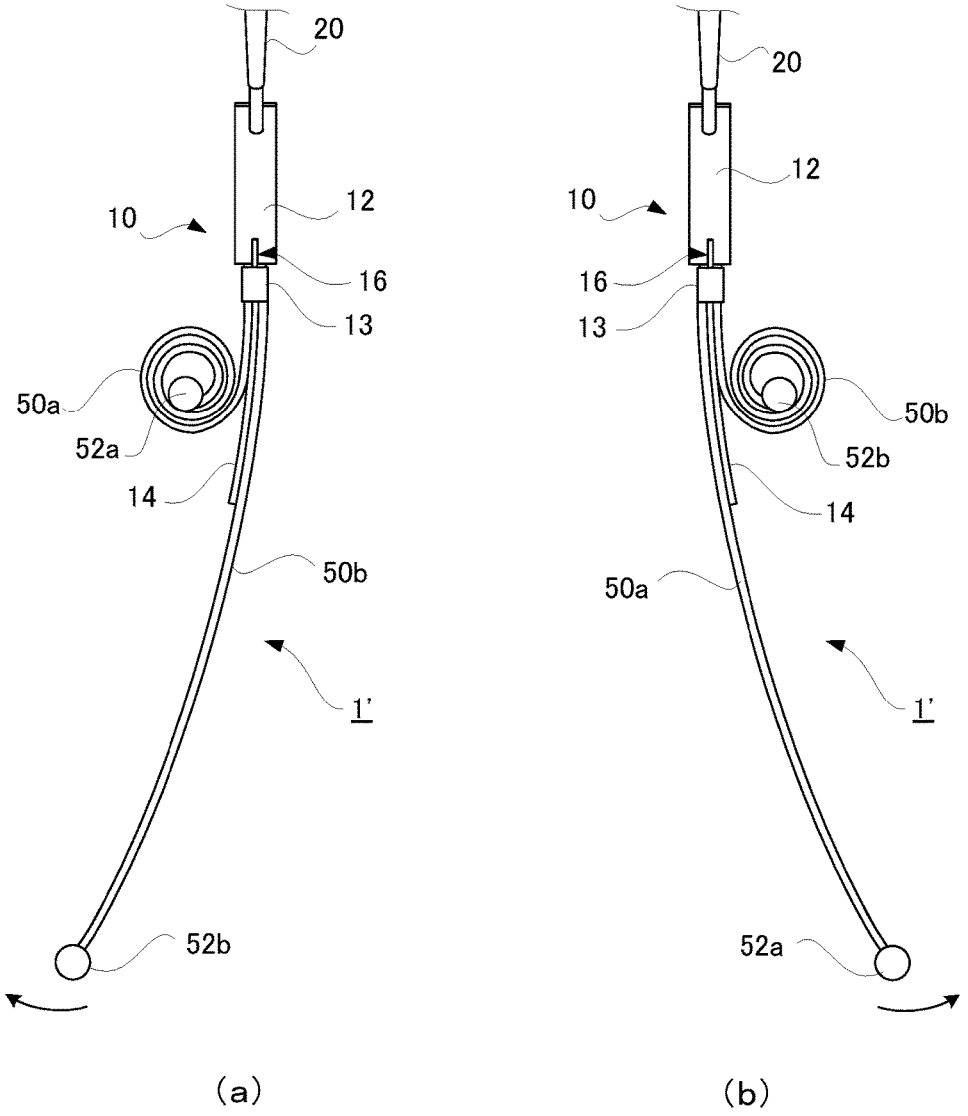
FIG. 14 shows front views of the sports practice tool shown in FIG. 13 in a state during use, and FIG. 14(*a*) and FIG. 14(*b*) each show an example of a state during use.

With the sports practice tool 1' shown in FIG. 13, when the force in the direction of the arrow acts on the distal end side of the second flexible part 14 to bend the second flexible part 14, one of the two elastic objects 50*a* and 50*b* that is located on the side opposite to the direction of bend stretches, and the other that is located on the same side as the direction of bend is contracted, as shown in FIGS. 14(*a*) and 14(*b*). Accordingly, it is possible to feel not only the flex movement of the second flexible part 14 but also the stretching and contracting movement of the elastic objects 50*a* and 50*b* during a swing, thus making it possible to more correctly understand the flex state of a golf club in each stage of a swing and making it easier to learn an efficient swing. The elastic objects 50*a* and 50*b* may be provided on the first flexible part 12 instead of the second flexible part 14, or may be provided on both the first flexible part 12 and the second flexible part 14.

Figure 15:
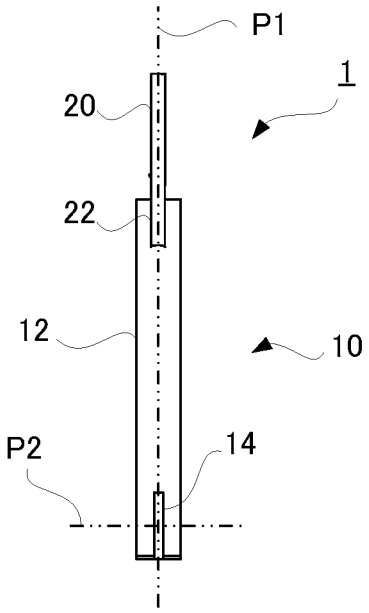
FIG. 15 is a front view of a sports practice tool according to yet another embodiment of the present invention.

The grip 20 of the sports practice tools of the above-described embodiments can be configured identically with the grip of a conventional golf club. Alternatively, as shown in FIG. 15, the grip 20 may be composed of a flat, plate-like object whose broader surface is perpendicular to the second imaginary plane P2, as with the second flexible part 14. With the sports practice tool 1 shown in FIG. 15, the grip 20 itself is more likely to be flexed and twisted, thus making it easier for a user to feel through the grip 20 the flex and twist that occur to the practice tool main body 10 during a swing and, also, making it easier to perform a counter movement that takes advantage of the principle of leverage on the grip 20 at impact.

Figure 16:
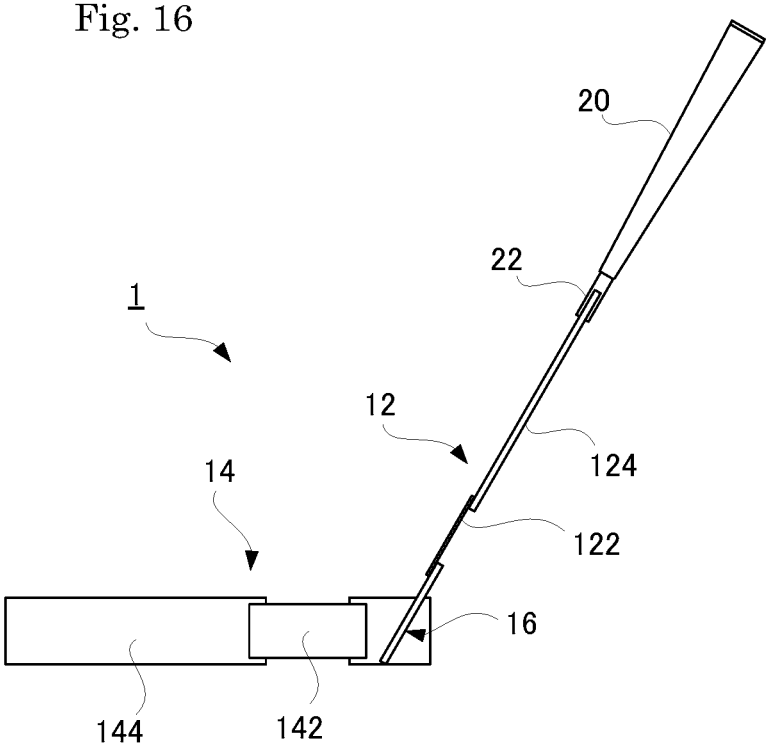
FIG. 16 is a side view of a sports practice tool according to yet another embodiment of the present invention.

How easily the first flexible part 12 and the second flexible part 14 deflectively deform may be uniform or may be non-uniform over the entire lengths of the first flexible part 12 and the second flexible part 14. For example, as shown in FIG. 16, the first flexible part 12 may be composed of a large-deformation part 122, which is more likely to deflectively deform, and a small-deformation part 124, which is less likely to deflectively deform than the large-deformation part 122, and the large-deformation part 122 may be connected to the connecting part 16. The large-deformation part 122 can be created by providing a smaller thickness than the small-deformation part 124 or can be made from a material that easily deforms, such as resin or rubber. As with the first flexible part 12, the second flexible part 14 can also be composed of a large-deformation part 142, which is more likely to deflectively deform, and a small-deformation part 144, which is less likely to deflectively deform than the large-deformation part 142, and the large-deformation part 142 can be connected to the connecting part 16.

Figure 17:
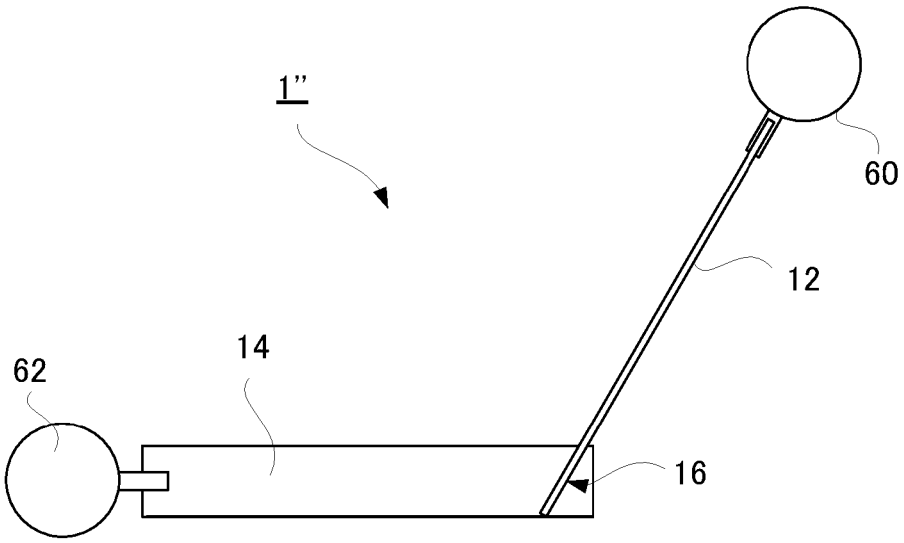
FIG. 17 is a side view of a sports practice tool according to yet another embodiment of the present invention.

The sports practice tools of the above-described embodiments are configured to be suitable for practicing a golf swing, but other than golf the present invention is applicable to practice tools for various ball games in a broad sense where an object that is in the form of a ball is hit with a rod-like object, and is also applicable to, for example, tennis and badminton rackets, ice hockey sticks, baseball bats, and the like. Furthermore, the sports practice tool of the present invention can also be used for practicing throwing a ball such as a baseball other than for practicing hitting an object. That is to say, a sports practice tool 1" shown in FIG. 17 can be created by providing the first flexible part 12 with, in place of the grip 20, a spherical object 60 having substantially the same size as a baseball or the like, and providing the distal end part of the second flexible part 14 with a weight 62 having, for example, a spherical shape in the sports practice tool 1 shown FIGS. 1 and 2. With the sports practice tool 1" shown in FIG. 17, when a user performs a ball-throwing movement, assuming that the spherical object 60 is a ball, it is possible to easily feel an efficient ball-throwing form in which inertial force resulting from the flex of one of the first flexible part 12 and the second flexible part 14 is used to cause the other to flex greatly.

REFERENCE SIGNS LIST

1 Sports practice tool
10 Practice tool main body
12 First flexible part
14 Second flexible part
20 Grip
P1 First imaginary plane
P2 Second imaginary plane

The invention claimed is:

1. A sports practice tool for swinging comprising:

a grip that extends in a longitudinal direction, a first flexible part that is in a rectangle plate shape, the plate shape being flat and defined in three dimensions that are a first length in a first length direction, a first width in a first width direction and a first thickness in a first thickness direction such that the first thickness is consistent both in the first length direction and in the first width direction, wherein each one of these directions is perpendicular to the other directions, the first width is greater than the first thickness, and the first length is greater than the first width such that plane surfaces, which are defined by the first length direction and the first width direction and face each other in the first thickness direction, are more flexible when bending in the first thickness direction than other surfaces, which face each other either in the first length direction or in the first width direction, when bending respectively in the first length direction or in the first width direction, a second flexible part that is in a rectangle plate shape, the plate shape being flat and defined by three dimensions, which are a second length in a second length direction, a second width in a second width direction and a second thickness in a second thickness direction such that the second thickness is consistent in the second length direction and in the second width direction, wherein each one of these directions is perpendicular to the other directions, the second width is greater than the second thickness, and the second length is greater than the second width such that plane surfaces, which are defined by the second length direction and the second width direction and face each other in the second thickness direction, are more flexible when bending in the second thickness direction than other surfaces, which face each other either in the second length direction or in the second width direction, when bending respectively in the second length direction or in the second width direction, wherein the first flexible part is connected to a distal end of the grip in the longitudinal direction of the grip such that the first length direction of the first flexible part is oriented to the longitudinal direction of the grip, a proximal portion of the second flexible part is connected to a distal portion of the first flexible part in the longitudinal direction of the grip such that the second thickness direction of the second flexible part is oriented to the first width direction of the first flexible part, wherein the first flexible part is notched at the distal portion in the first length direction so that a notch portion is formed extending for a predetermined length in the first length direction and the second flexible part is connected to the first flexible part by being inserted into the notch portion of the first flexible part, the grip, the first flexible part and the second flexible part are arranged in this order from the grip in the longitudinal direction of the grip, the first flexible part and the second flexible part are independently formed from different members, and an obtuse angle (θ) is formed between the first flexible part and the second flexible part, in a view seen from the first width direction.

2. The sports practice tool according to claim 1, further comprising an elongated elastic object having two sides, wherein one side of the elastic object is fixed to at least the first flexible part or the second flexible part, and the other side of the elastic object curls away from the first flexible part or the second flexible part and contracts into a spiral shape due to resilience.

3. The sports practice tool according to claim 1, wherein the notch portion is formed in a center at the distal portion of the first flexible part in the first length direction, which is an opposite to a proximal end where the grip is connected, so that the notch portion divides the distal portion into halves in the first width direction, and the second flexible part is fixed to the first flexible part by being inserted into the notch portion of the first flexible part.

4. The sports practice tool according to claim 3, further comprising:

a weight, wherein the weight is attached to a distal end of the second flexible part in the second length direction.

5. The sports practice tool according to claim 1, wherein the first flexible part is entirely made of a metallic material.

6. The sports practice tool according to claim 1, wherein the first flexible part is entirely made of a fiber reinforced plastic, which is composited with either carbon fibers or graphite.

7. The sports practice tool according to claim 1, further comprising:

a weight, wherein the weight is attached to the second flexible part.

8. The sports practice tool according to claim 1, further comprising:

a weight, wherein the weight is attached to a distal end of the second flexible part in the second length direction.

9. The sports practice tool according to claim 1, further comprising:

an angle adjusting means that functions to adjust the obtuse angle from more an 90 degrees to less than 180 degrees.

10. The sports practice tool according to claim 1, wherein the obtuse angle is set at about 135 degrees.

11. The sports practice tool according to claim 1, wherein the obtuse angle is set at degrees such that the second flexible part extends parallel to a ground when a user of the sports practice tool addresses for a golf swing with the sports practice tool, the user standing on the ground.

12. The sports practice tool according to claim 1, wherein the first length of the first flexible part is equal to the second length of the second flexible part.

13. The sports practice tool according to claim 12, wherein the first width of the first flexible part is equal to the second width of the second flexible part.

14. The sports practice tool according to claim 1, wherein the first width of the first flexible part is equal to the second width of the second flexible part.

* * * * *